US007004802B1

(12) United States Patent
Wolford

(10) Patent No.: US 7,004,802 B1
(45) Date of Patent: Feb. 28, 2006

(54) TAIL CONE ASSEMBLY

(76) Inventor: Bruce D. Wolford, 1617 E. 12th, Spokane, WA (US) 99202

( * ) Notice: Subject to any disclaimer, the term of this patent is extended or adjusted under 35 U.S.C. 154(b) by 0 days.

(21) Appl. No.: 10/931,342

(22) Filed: Aug. 31, 2004

(51) Int. Cl.
*B63H 11/103* (2006.01)

(52) U.S. Cl. ..... 440/47; 440/38

(58) Field of Classification Search ..... 440/38, 440/42, 43, 46, 47
See application file for complete search history.

(56) References Cited

U.S. PATENT DOCUMENTS

| | | | | |
|---|---|---|---|---|
| 3,279,704 | A | 10/1966 | Englehart et al. | 239/265.43 |
| 4,176,616 | A | 12/1979 | Robins | 440/43 |
| 5,244,425 | A | 9/1993 | Tasaki et al. | 440/47 |
| 5,658,176 | A | 8/1997 | Jordan | 440/46 |
| 5,679,035 | A | 10/1997 | Jordan | 440/47 |
| 5,863,229 | A | 1/1999 | Matte | 440/47 |
| 5,879,209 | A | 3/1999 | Jones | 440/42 |
| 6,224,434 | B1 * | 5/2001 | Varney et al. | 440/38 |
| 6,293,836 | B1 | 9/2001 | Blanchard | 440/47 |

OTHER PUBLICATIONS

Wet Wolf Technologies Adjust-A-Trust Product Brochure (tri-fold mailer), 2002.

Adjust-A-Thrust installation Instructions and updated tuning sheet, Apr. 2, 2002.

http://www.wetwolf.com/, Jan. 20, 2004, pp. 1-4.
http://www.wetwolf.com/pot/, Jan. 20, 2004, pp. 1-3.
http://www.wetwolf.com/sea/, Jan. 20, 2004, pp. 1-3.
http://www.wetwolf.com/yam/, Jan. 20, 2004, pp. 1-2.
http://www.wetwolf.com/ski/, Jan. 20, 2004, pp. 1-3.
http://www.wetwolf.com/kaw/, Jan. 20, 2004, pp. 1-2.
http://www.wetwolf.com/tunvar.html, Jan. 20, 2004, pp. 1-2.
http://www.wetwolf.com/upd.html, Jan. 20, 2004, pp. 1-2.
http://www.wetwolf.com/about.html, Jan. 20, 2004, pp. 1-2.

* cited by examiner

*Primary Examiner*—Lars A. Olson
(74) *Attorney, Agent, or Firm*—Wells St. John P.S.

(57) ABSTRACT

A tail cone assembly for a watercraft jet pump includes a tail cone body with a shuttle recess, a self-actuated shuttle biased into the shuttle recess, and a pump back pressure inlet orifice through the tail cone body and into the shuttle recess. The shuttle may have a rear portion with an outer conical surface of at least two different conical slopes that are positioned to determine two discrete stages of jet pump discharge area. The shuttle recess may include a side wall with a grit exhaust groove therein. The grit groove and inlet orifice may both be positioned at gravitational low points within the assembly. The assembly may further include a grit screening device associated with the inlet orifice that restricts grit having a size greater than or equal to a shuttle clearance from entering the inlet orifice.

24 Claims, 8 Drawing Sheets

TAIL CONE ASSEMBLY

TECHNICAL FIELD

This invention pertains to tail cone assemblies of watercraft jet pumps and to methods of increasing watercraft jet pump discharge velocity.

BACKGROUND OF THE INVENTION

A variety of factors affect the top speed of a watercraft that is jet pump driven. Discharge nozzle size is one such factor. Reducing the size of the jet pump discharge nozzle increases the velocity of water exiting the pump, assuming a constant volumetric flow rate of water. Accordingly, at the maximum volumetric flow rate of a jet pump, reducing discharge nozzle size increases top speed. Unfortunately, reducing discharge nozzle size also restricts water flow through the nozzle and reduces volumetric flow rate in the lower range of pump operation. Lower volumetric flow rate thus impairs acceleration at speeds below the top speed of a watercraft and may be particularly noticeable when accelerating from a standstill.

Conversely, increasing discharge nozzle size reduces top speed since, at the maximum volumetric flow rate of the watercraft, discharge velocity is reduced. Even so, enlarging discharge nozzle size bears the advantage of improving acceleration at lower speeds. Conventionally, watercraft manufacturers selected a balance between top speed and acceleration and established discharge nozzle size accordingly. Some individuals desiring a different balance between top speed and acceleration chose to bore the discharge nozzle of their watercraft, increasing discharge nozzle size. Others used nozzles having adjustable sizes, for example, by installing different size nozzle rings.

Eventually, manufacturers began to use the tail cone of a jet pump as one of its tuning components. The tail cone typically mounts to the pump stator and functions as a cap for the impeller shaft bearings. By virtue of its cone shape, a tail cone may also assist with hydrodynamic flow through the jet pump, refocusing water flow into a solid jet stream as it exits the discharge nozzle. For example, the size and position of the tail cone may be altered to vary back pressure in the discharge nozzle area. As known to those of ordinary skill, increasing back pressure can yield more efficient processing as water moves through the pump so as to increase volumetric flow rate and, accordingly, acceleration. However, such efforts attempted in the past did not produce improvements in top speed. Other tuning efforts have included a lengthened tail cone with an attached rod extending from the tail cone into the discharge nozzle. The rod reduces the overall area of the discharge nozzle cross section and the effect is identical to decreasing nozzle size. Namely, top speed may increase, but a jet pump fitted with such a tail cone/rod assembly may provide less acceleration at lower speeds.

As may be appreciated from the discussion above, conventional jet pump performance improvements have included either improving acceleration or improving top speed, but not both. Additionally, improvements gained in acceleration sacrificed top speed and vice versa. The best balance between acceleration and top speed often may be the original nozzle installed by the manufacturer. Accordingly, jet pump driven watercraft exhibit a very limited range of tuneability. At least for the reasons indicated, a desire exist to enhance jet pump top speed without sacrificing acceleration and perhaps to even improve acceleration at lower speeds while still increasing top speed.

SUMMARY OF THE INVENTION

According to one aspect of the invention, a tail cone assembly for a watercraft jet pump includes a tail cone body having a front end adapted for mounting and a rear end with a shuttle recess formed therein, a self-actuated shuttle biased into the shuttle recess, and a pump back pressure inlet orifice through the tail cone body and into the shuttle recess. The shuttle has a rear portion with an outer conical surface positioned to determine jet pump discharge area upon extension of the shuttle from the shuttle recess. By way of example, the shuttle recess may include a side wall with a grit exhaust groove therein. The grit groove and inlet orifice may both be positioned at gravitational low points within the assembly. The shuttle recess may include a side wall and a front portion of the shuttle may include an outer surface complimentary to the side wall. The assembly may exhibit a clearance of from about 0.020 to about 0.040 inches between the side wall and the outer surface. The assembly may further include a grit screening device associated with the inlet orifice that restricts grit having a size greater than or equal to the shuttle clearance from entering the inlet orifice. Aspects of the invention include such a tail cone assembly in a watercraft jet pump and/or a personal watercraft.

According to another aspect of the invention, a tail cone assembly for a watercraft jet pump includes a tail cone body having a front end adapted for mounting and a rear end with a shuttle recess formed therein, a self-actuated shuttle biased into the shuttle recess, and a pump back pressure inlet orifice through the tail cone body and into the shuttle recess. The shuttle has a rear portion with an outer conical surface of at least two different conical slopes that are positioned to determine at least two stages of jet pump discharge area upon extension of the shuttle from the shuttle recess. By way of example, the at least two slopes may consist of two slopes. The at least two stages may be discrete stages. Aspects of the invention include such a tail cone assembly in a watercraft jet pump that exhibits three discrete discharge area stages consisting of a low-range stage, a mid-range stage, and a high-range stage. The low-range stage corresponds to a shuttle position where the discharge area is unchanged by the shuttle. The mid-range stage corresponds to a shuttle position where the discharge area is changed by a portion of the shuttle having a first conical slope. The high-range stage corresponds to a shuttle position where the discharge area is changed by a portion of the shuttle having a second conical slope. Aspects of the invention further include tail cone assemblies in a personal watercraft exhibiting three discrete jet pump discharge area stages.

According to a further aspect of the invention, a tail cone assembly for a watercraft jet pump includes a tail cone body having a front end adapted for mounting and a rear end with a shuttle recess formed therein, a self-actuated shuttle biased into the shuttle recess, a pump back pressure inlet orifice through the tail cone body and into the shuttle recess, and a grit screening device associated with the inlet orifice. The shuttle recess has a side wall and a grit exhaust groove in the side wall. The shuttle has a front portion with an outer surface that is complementary to the side wall, except for the grit exhaust groove in the side wall. The shuttle has a rear portion with an outer conical surface of two different conical slopes that are positioned to determine two discrete stages of jet pump discharge area upon extension of the shuttle from the shuttle recess. The assembly exhibits a shuttle clearance between the side wall and the complementary outer surface. The grit screening device restricts grit having a size greater than or equal to the shuttle clearance from entering the inlet orifice. Both the grit groove and the inlet orifice are positioned at gravitational low points within the assembly. By way of example, aspects of the invention include the tail cone assembly in a watercraft jet pump and/or a personal watercraft.

BRIEF DESCRIPTION OF THE DRAWINGS

Preferred embodiments of the invention are described below with reference to the following accompanying drawings.

FIGS. 5–7 are side views of the tail cone assembly of FIG. 1 mounted in a jet pump cut-away to show different shuttle positions.

FIG. 9 is a graph showing qualitative changes in discharge area with respect to shuttle position for the tail cone assembly shown in FIG. 1 as well as a tail cone assembly including the single-stage shuttle shown in FIG. 8.

DETAILED DESCRIPTION OF THE PREFERRED EMBODIMENTS

Figure 1:
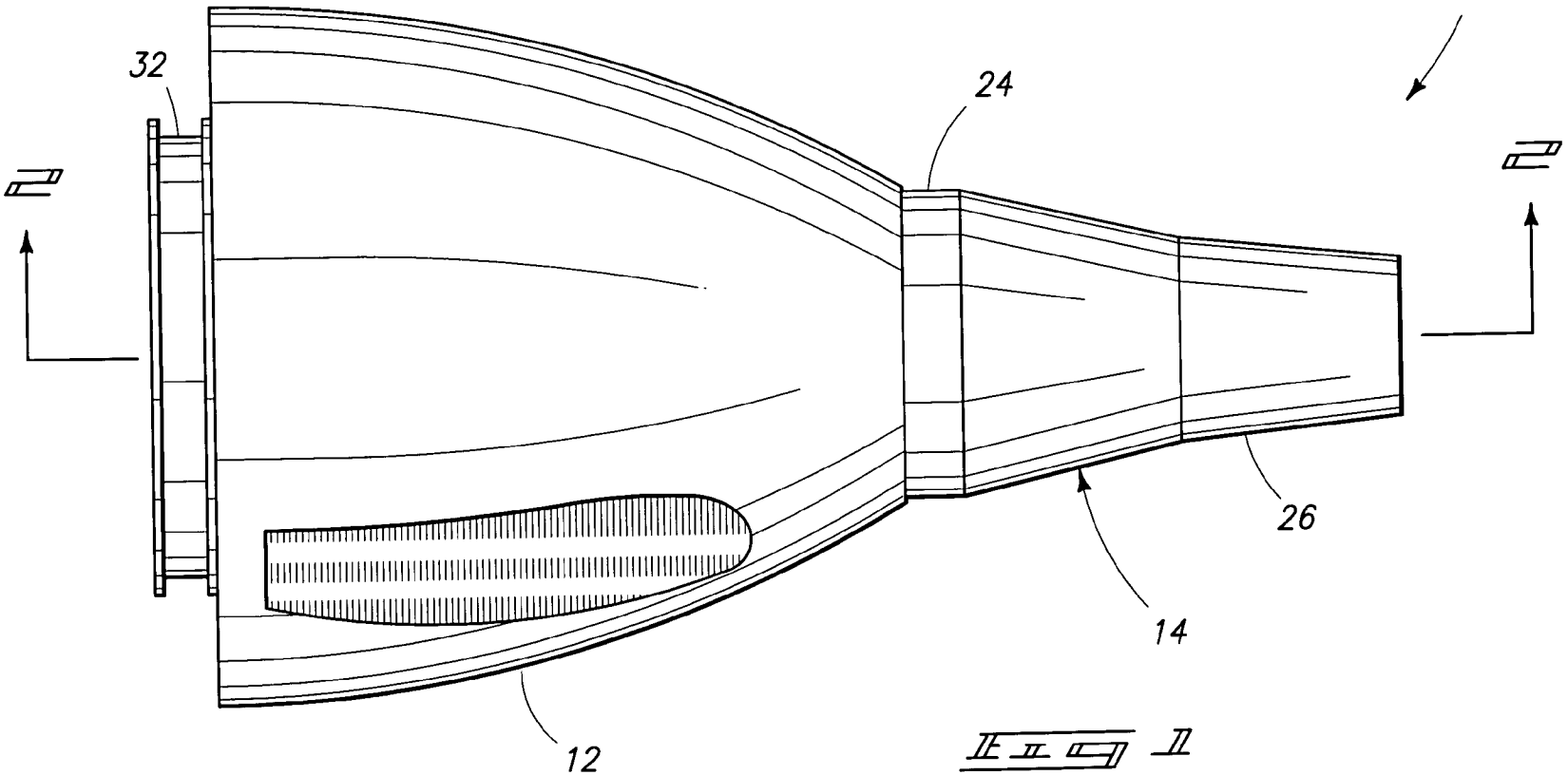
FIG. 1 is a side view of a tail cone assembly according to one aspect of the invention.

In one aspect of the invention, a tail cone assembly for a watercraft jet pump includes a tail cone body having a front end adapted for mounting and a rear end with a shuttle recess formed therein, a self-actuated shuttle biased into the shuttle recess, and a pump back pressure inlet orifice through the tail cone body and into the shuttle recess. The shuttle has a rear portion with an outer conical surface positioned to determine jet pump discharge area upon extension of the shuffle from the shuttle recess. Turning to FIG. 1, a side view is shown of a tail cone assembly 10 that includes a body 12 and a shuttle 14. A front end of tail cone assembly 10 includes an O-ring groove 32. An O-ring (not shown) may be placed within O-ring groove 32 to function as a seal when tail cone assembly 10 is mounted to components of a watercraft jet pump. Conventionally, a tail cone often functions as a bearing cap cover from impeller shaft bearings. Tail cone assembly 10 continues to satisfy the desired function despite the modifications described herein. Specific adaptations for mounting a tail cone assembly will vary depending upon the overall pump design selected by the watercraft jet pump manufacturer. Herein, tail cone assembly 10 is shown to include O-ring groove 32 as well as bolt holes 50 (shown in FIGS. 2–4) that enable one type of mounting. However, the invention is not limited to the specific mounting type described herein and may be adapted to most, if not all, watercraft jet pumps.

Figure 2:
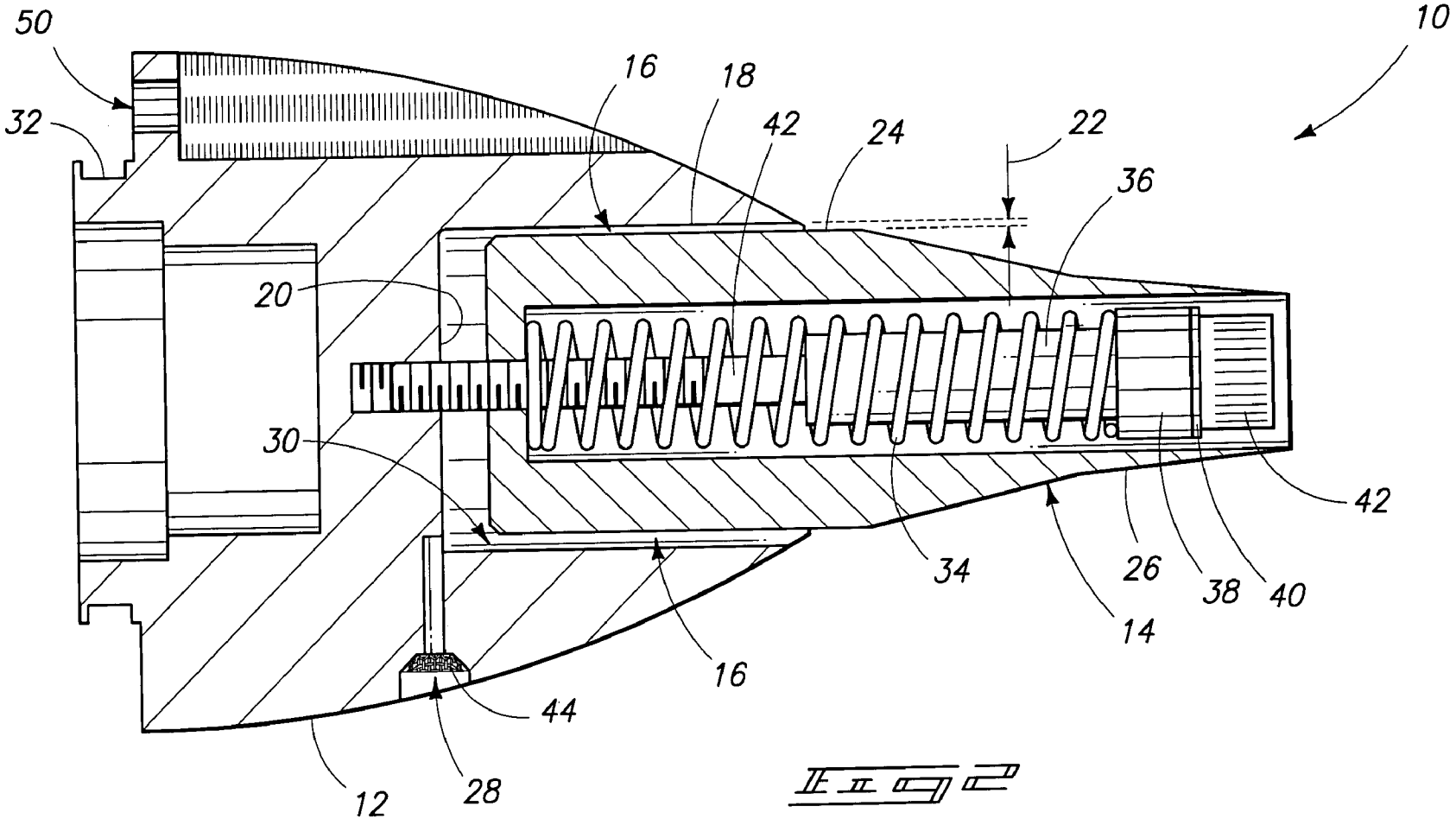
FIG. 2 is a partial sectional view of the tail cone assembly shown in FIG. 1 taken along line 2—2.

Tail cone assembly 10 of FIG. 1 is shown in partial cross-sectional view in FIG. 2. Noticeably, a recess 16 is shown formed within body 12 for receiving shuttle 14. Recess 16 is formed within a rear end of body 12 opposite the front end adapted for mounting. Shuttle 14 has a rear portion with an outer surface 26. Outer surface 26 is conical and, as will be appreciated from the discussion below, is positioned to determine jet pump discharge area upon extension of shuttle 14 from recess 16. FIGS. 1–4 show shuttle 14 partially extended from shuttle recess 16. However, it is apparent that a spring 34 biases shuttle 14 into recess 16 such that extension of shuttle 14 as shown in FIG. 2 may be accomplished by exertion of a force to overcome the bias of spring 34. It is conceivable that alternative conventional mechanical devices may be used to bias shuttle 14 into recess 16. However, springs such as shown have proven effective.

In the particular example of the various aspects of the invention shown in the Figures, an inlet orifice 28 exposes recess 16 to watercraft jet pump back pressure through body 12 of tail cone assembly 10. Exposing recess 16 to back pressure provides a displacement force upon shuttle 14 that may overcome the bias of spring 34 depending upon the properties selected for such spring or alternative bias mechanism. The described components provide a self-actuation feature. That is, shuttle 14 automatically extends from recess 16 upon achieving predetermined operational parameters within the watercraft jet pump.

The operator of a watercraft using a self-actuated shuttle need not monitor pump back pressure, volumetric flow rate, discharge velocity, watercraft speed, etc. and determine an appropriate moment for extension of shuttle 14 to achieve performance improvements. Instead, given the aspects of the invention and examples described herein, those of ordinary skill may modify tail cone assembly 10 and adapt it to a variety of types of watercraft jet pumps to obtain self-actuated shuttle extension and, thus, performance improvements. A tail cone assembly according to the aspects of the invention bears the advantage of being self-actuated in comparison to conventional jet pump control mechanisms that use operator controls. Also, tail cone assemblies according to the aspects of the invention are highly adaptable to a variety of types of watercraft jet pumps and to a variety of tuning criteria, depending upon the desires of a particular watercraft operator.

A tail cone assembly according to the present aspect of the invention may have a shuttle recess that includes a side wall with a grit exhaust groove therein. Also, the grit groove and/or inlet orifice may be positioned at gravitational low points within the assembly. Preferably, both the grit groove and inlet orifice are so positioned. Further, the shuttle recess may include a side wall and a front portion of the shuttle may have an outer surface complementary to the side wall. The assembly may exhibit a clearance of from about 0.020 to about 0.040 inches (0.5 to about 1.0 millimeters) between the side wall and the outer surface. Further, the assembly may exhibit a shuttle clearance between the side wall and the outer surface and the assembly may further include a grit screening device. The grit screening device may be associated with the inlet orifice and restrict grit having a size greater than or equal to the shuttle clearance from entering the inlet orifice. The various features described above may be useful in ensuring continuous operation of a tail cone assembly without clogging.

Figure 3:
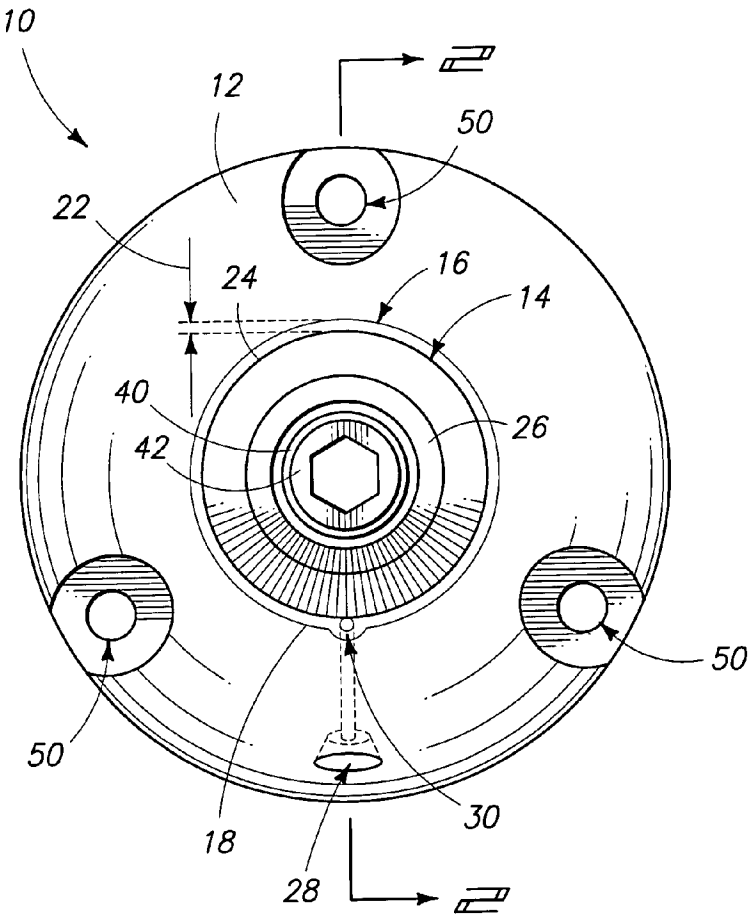
FIGS. 3 and 4 are side views of the tail cone assembly shown in FIG. 1.
Figure 4:
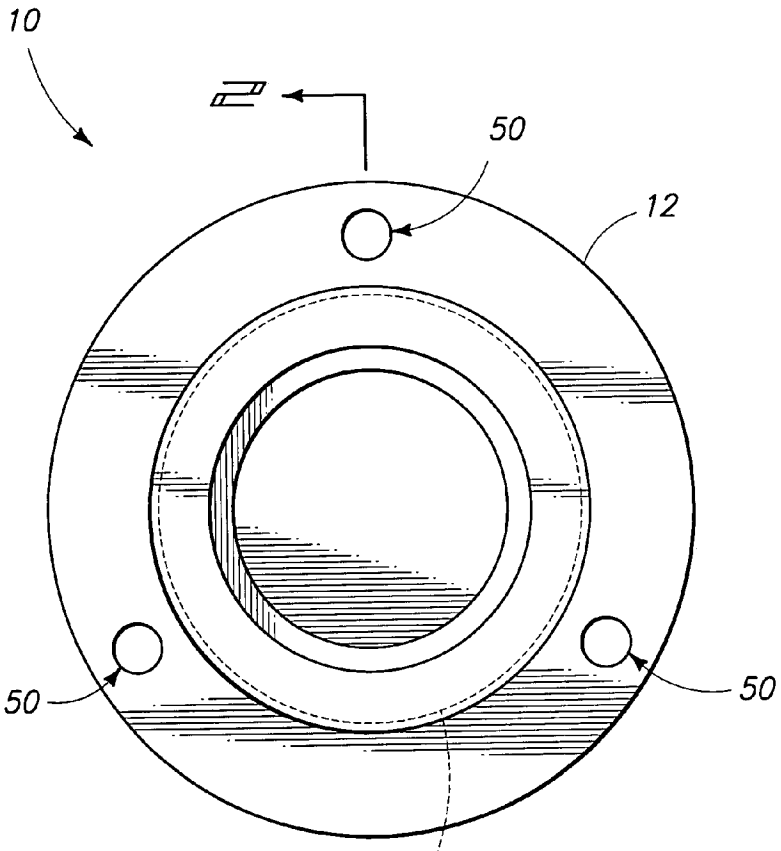

As is apparent from FIGS. 2 and 3, a clearance 22 is provided between side wall 18 and an outer surface 24 of a front portion of shuttle 14. Outer surface 24 is complementary to side wall 18 such that clearance 22 is substantially constant around a periphery of outer surface 24. As an alternative to providing clearance 22, other embodiments may instead provide a seal (not shown) between side wall 18 and outer surface 24 of the front portion of shuttle 14. Such a seal could be an O-ring allowing shuttle 14 to extend in and out of recess 16, but not allowing passage of water past shuttle 14.

Observations during testing indicated that providing such a seal was inferior to the design shown in FIGS. 2 and 3. Initially, the seal was removed and a relatively narrow clearance less than 0.010 inches (0.25 millimeters) provided. The shuttle function improved due to deceased clogging since small grit could flush past shuttle 14 through the clearance provided without the same clogging experienced with a seal in place. However, some clogging still occurred from larger grit. An expectation existed that removing the seal might create problems with shifting shuttle 14 in and out of recess 16. However, the water (that is, pressure) leaking past outer surface 24 was accommodated merely by changing the characteristics of spring 34 to account for any loss of back pressure within recess 16. Further experimentation similarly indicated that increasing clearance 22 to from about 0.020 to about 0.040 inches could also be accommodated with changes in characteristics of spring 34 while allowing flushing of larger grit. Despite the pressure losses incurred, the shifting function of shuttle 14 may be maintained while providing the advantage of grit flushing around outer surface 24 of the front portion of shuttle 14.

FIGS. 2 and 3 also show a grit groove 30 in side wall 18. In FIGS. 2 and 3, grit groove 30 constitutes the only exception to an otherwise uniform clearance between outer surface 24 and side wall 18. Alternative embodiments include providing multiple grit grooves, for example, by spacing them uniformly around side wall 18. However, past performance observations indicate that a single grit groove may be adequate. The grit flushing efficiency of grit groove 30, as well as inlet orifice 28 may be enhanced by positioning such components at gravitational low points, such as shown in FIGS. 2 and 3. Since grit settles in water by virtue of gravity, an expectation exists that grit may preferentially flush through clearance 22 at a gravitational low point when mounted on a watercraft jet pump. Locating grit groove 30 at such point provides a larger clearance for grit flushing at a point where the most grit may accumulate.

When back pressure overcomes the bias of shuttle 14 into recess 16, water (possibly containing grit) fills recess 16 as shuttle 14 extends out of recess 16. Upon shifting back into recess 16, grit may remain potentially clogging the clearances provided. However, some grit will flush back out of inlet orifice 28 and orienting inlet orifice 28 at a gravitational low point will facilitate grit flushing in a manner similar to that discussed for grit groove 30.

As a still further measure to avoid grit clogging problems, a grit screening device may be provided in association with inlet orifice 28. In FIGS. 2 and 3, a grit screen 44 is shown provided within a countersunk opening centered over inlet orifice 28. Conceivably, once given the teachings herein, those of ordinary skill will appreciate that a variety of conventional grit screening devices, such as mesh, etc., in a variety of configurations may be provided in association with inlet orifice 28. FIGS. 2 and 3 present one simple but effective possibility. As a further advantage, clearance 22 and the size restrictions of a grit screening device may be designed in conjunction with one another so that no grit exceeding clearance 22 may enter recess 16 through inlet orifice 28. If a grit groove is additionally provided, then proper grit flushing may be additional ensured.

Regarding the specific complementary configurations for side wall 18 of recess 16 and outer surface 24 of the front portion of shuttle 14, a variety of possibilities exist. Given the right conical shape of body 12 in tail cone assembly 10, shuttle recess 16 was selected to provide a right circular cylindrical opening. Accordingly, a complementary outer surface 24 includes an outer cylindrical surface. However, other configurations may be desirable, for example, in the circumstance where body 12 of tail cone assembly 10 does not have a right conical shape.

Regarding the specific configurations for inlet orifice 28, shuttle recess 16 is shown to include a bottom 20 and inlet orifice 28 enters shuttle recess 16 through bottom 20. However, inlet orifice may instead enter recess 16 at a different point though bottom 20 or through side wall 18. Multiple inlet orifices might be provided.

Since a variety of configurations are possible for the complementary shuttle front portion and shuttle recess, it follows that a variety of configurations are possible for the shuttle rear portion, such as outer surface 26 shown in FIGS. 1–3. As will be appreciated from the discussion below, selection of configurations for outer surface 26 may significantly influence variation in discharge area with respect to shuttle position. As one example, outer surface 26 may correspond to a right circular cone.

Described mathematically, a cone is typically considered to be the surface generated by a straight line passing through a fixed point and moving along a fixed curve. In the circumstance where the straight line is instead a curved line, a conical surface of varying slope may be generated whereas a straight line generates a surface of a single (linear) slope. When the generating line passes through a fixed point and moves along a fixed curve, where the curve is a circle, a circular cone is generated. Where the fixed curve is an ellipse, an elliptical cone is generated. Other fixed curves may generate other cone types and may be designed to correspond with different shapes of a jet pump discharge nozzle. A right circular cone has a base perpendicular to an altitude line of the cone, as commonly known in the study of geometry. It will be appreciated from FIGS. 1–3 that outer surface 26 of shuttle 14 corresponds to a right circular cone.

In another aspect of the invention, a tail cone assembly for a watercraft jet pump may include a shuttle having a rear portion with an outer conical surface of at least two different conical slopes that are positioned to determine at least two stages of jet pump discharge area upon extension of the shuttle from a shuttle recess of a tail cone body. As may be appreciated from FIGS. 1–3, shuttle 14 constitutes one example of a shuttle having at least two different conical slopes.

Figure 8:
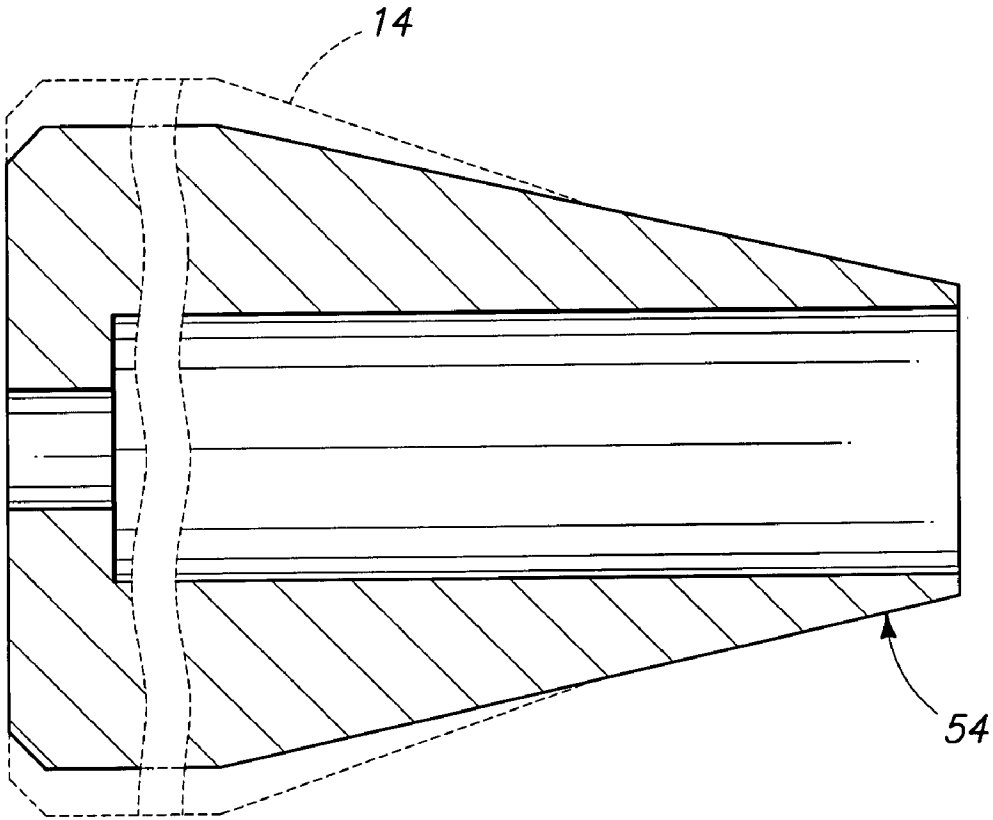
FIG. 8 is a side view of a shuttle as an alternative to the shuttle shown in FIG. 1 with a comparative outline of the FIG. 1 shuttle shown in dashed lines.
Figure 11:
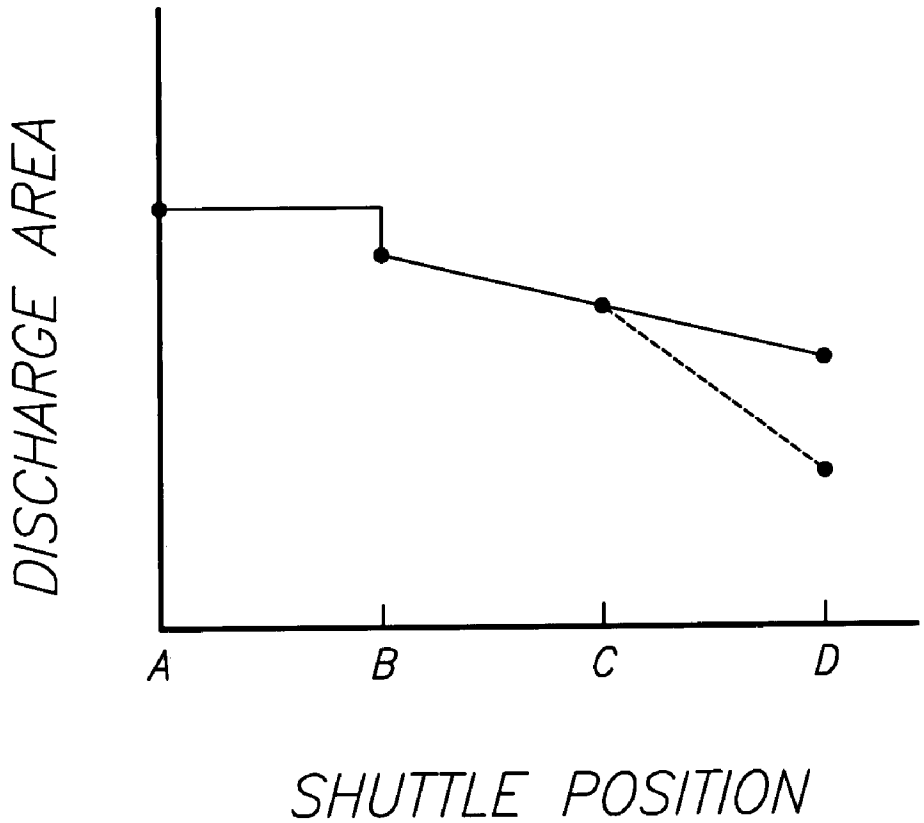

Aspects of the invention also include shuttles with a rear portion having a single conical slope. FIG. 8 shows a cross-section of a shuttle 54 having a single conical slope, in other words, a single stage shuttle. Shuttle 54 is superimposed over a profile of shuttle from FIGS. 1–3 shown in dashed lines for the purpose of comparison. While a portion of shuttles 54 and 14 is identical, the diameter of the remaining portion of shuttle 14 is shown to increase selectively so as to provide a second conical slope. An effect of the particular change in configuration shown is to provide a shuttle requiring a slightly larger diameter recess in the body of a tail cone assembly to accommodate the larger diameter shuttle while still maintaining the same clearance as present for shuttle 54. Certainly, the at least 2 different conical slopes may be provided by making other configuration changes to shuttle 54. Preferably, a shuttle having at least two different conical slopes consists of two conical slopes.

A tail cone assembly including a shuttle with two different conical slopes may be used in a watercraft jet pump so as to provide three discrete discharge area stages consisting of a low-range stage, a mid-range stage, and a high-range stage.

A shuttle with a single conical slope may provide a low-range stage and a mid-range stage. The low-range stage may correspond to a shuttle position where the discharge area is unchanged by the shuttle. A mid-range stage may correspond to a shuttle position where the discharge area is changed by a portion of the shuttle having a first conical slope. A high-range stage may correspond to a shuttle position where the discharge area is changed by a portion of the shuttle having a second conical slope. Understandably, aspects of the invention include personal watercraft exhibiting three discrete jet pump discharge area stages, whether enabled by the specific mechanisms presented in the Figures and described herein or by alternative mechanisms within the scope of the present description.

Figure 5:
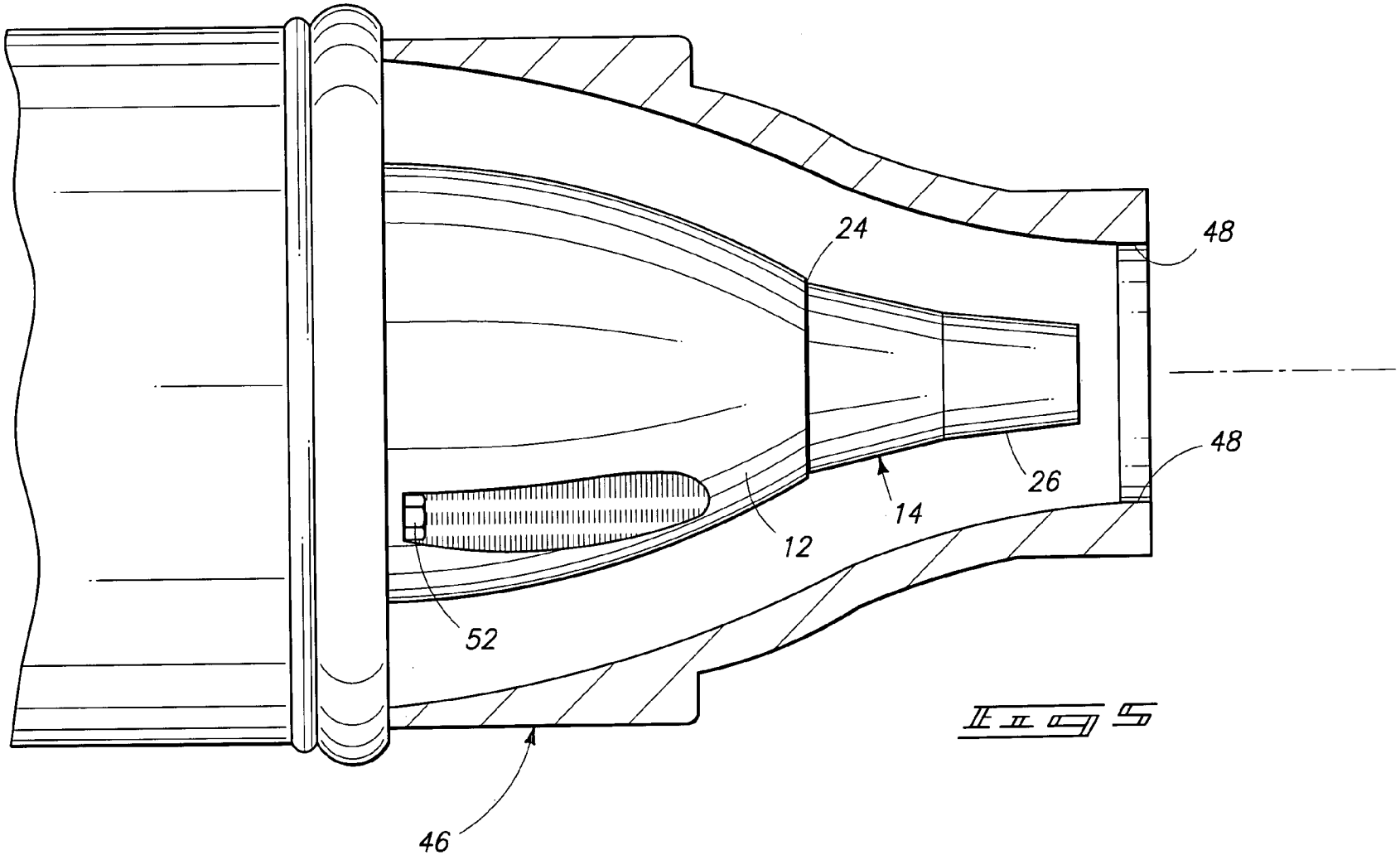
Figure 5:
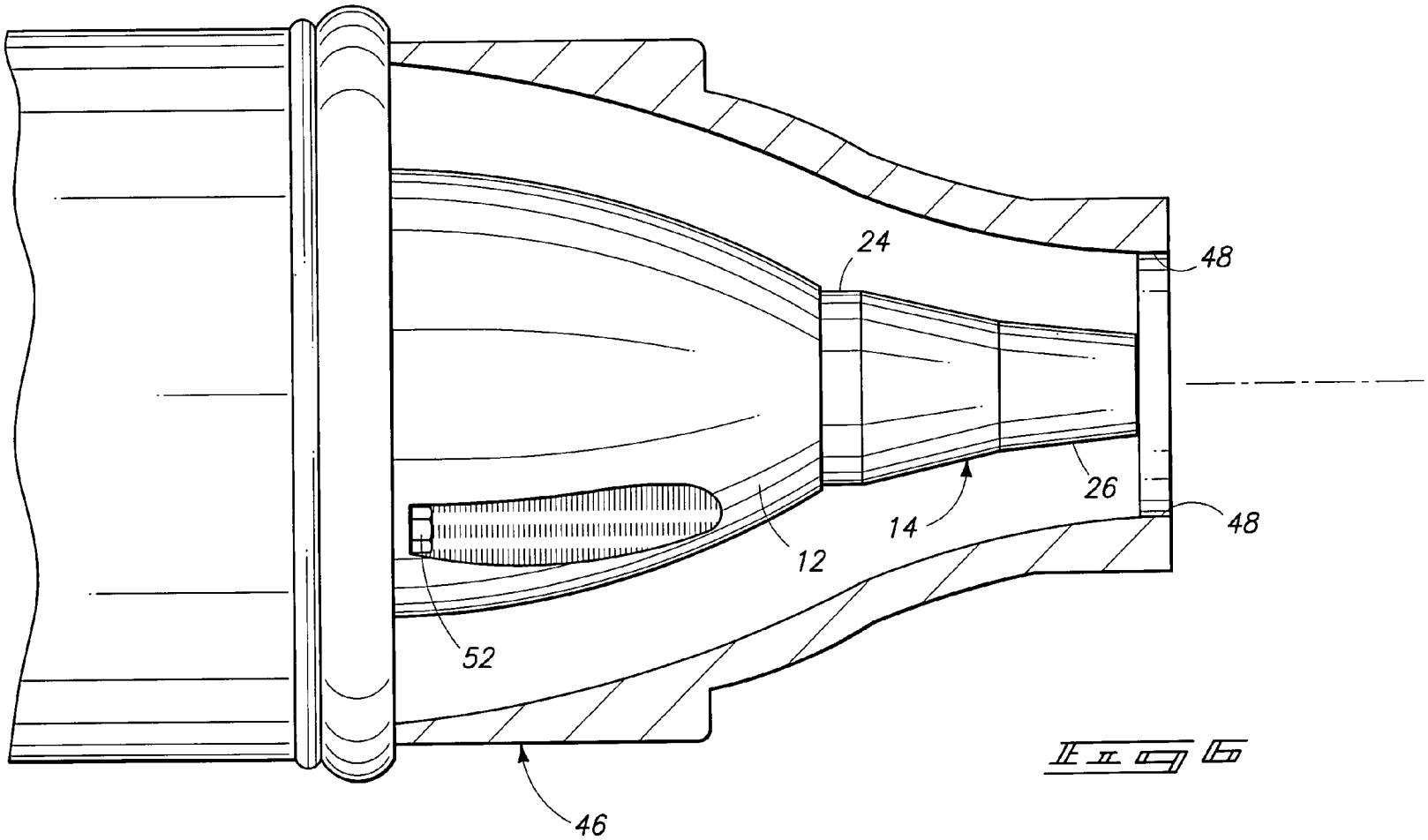
Figure 11:
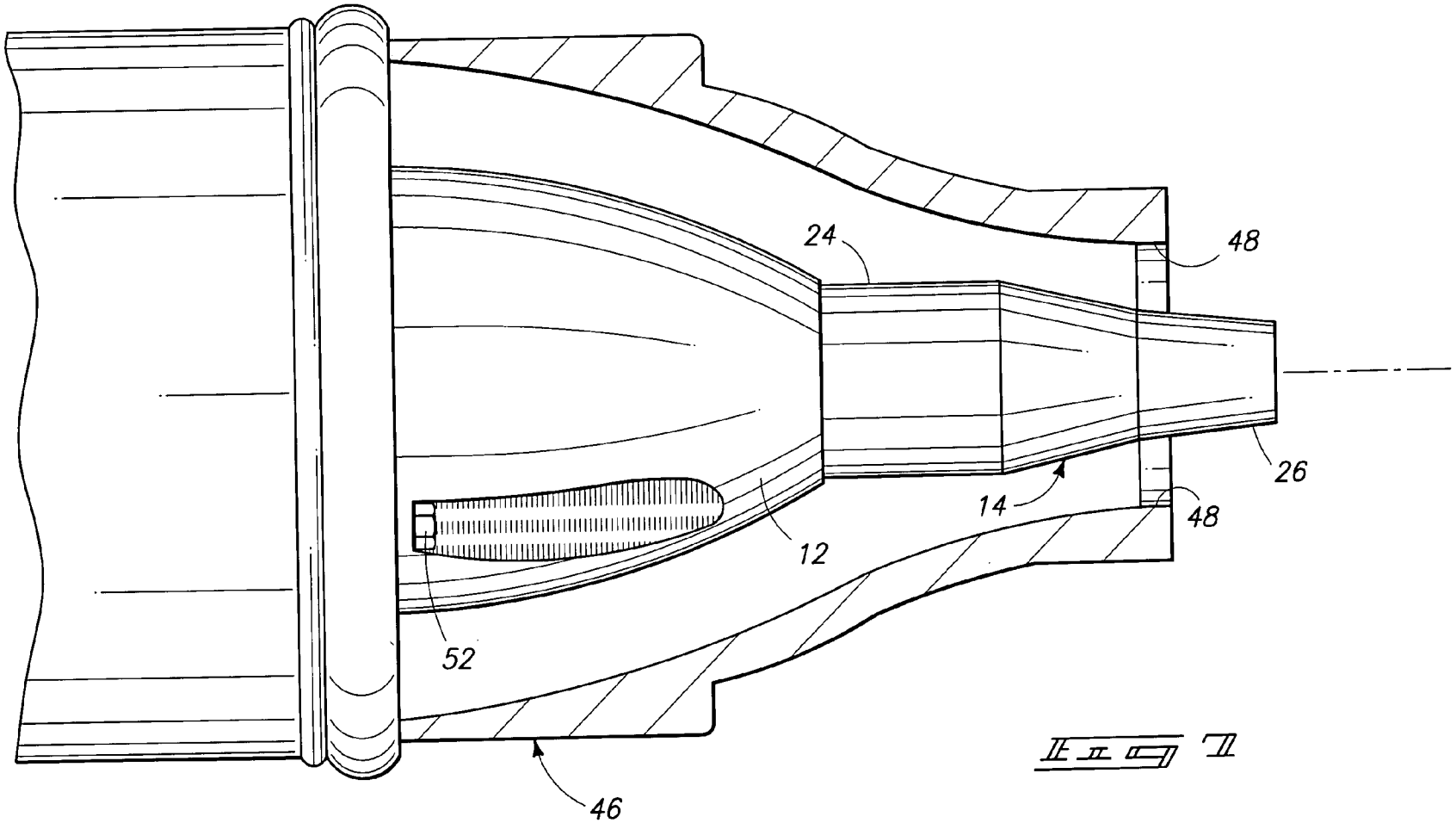

Turning to FIGS. 5–7, tail cone assembly 10 is shown mounted to a watercraft jet pump using bolts 52 inserted through bolt holes 50. FIGS. 5–7 are partial cut-away views of a pump housing 46 showing shuttle 14 position with respect to a discharge nozzle 48. FIG. 5 shows shuttle 14 within a low-range stage corresponding to a shuttle position where the discharge area defined by discharge nozzle 48 and any portion of shuttle 14 extending into discharge nozzle 48 is unchanged by shuttle 14.

FIG. 9 shows one qualitative example of changes in discharge area with respect to shuttle position. A low-range stage of discharge area occurs when shuttle 14 is between positions A and B. Namely, as apparent from FIG. 9, discharge area does not change with respect to shuttle position and instead merely reflects the discharge area determined by discharge nozzle 48 alone. Shuttle position A corresponds to shuttle 14 in its fully retracted position.

Shuttle position B referenced by FIG. 9 is shown in FIG. 6. Shuttle 14 extends to the point where a rear portion of shuttle 14 having outer surface 26 first begins to enter discharge nozzle 48. As shuttle position continues to extend into discharge nozzle 48, discharge area gradually decreases as shown in FIG. 9 and as determined by the conical slope, or possible other shape, of outer surface 26. Accordingly, shuttle 14 defines a mid-range stage corresponding to the shuttle being between shuttle positions B and C shown in FIG. 9. In the mid-range stage, discharge area is changed by portion of shuttle 14 having a first conical slope.

Shuttle position C is shown in FIG. 7. Shuttle 14 extends to the point where a rear portion of shuttle 14 having outer surface 26 with a different conical slope first begins to enter discharge nozzle 48. As shown in FIG. 9, by the dashed line, the different conical slope of shuttle 14 produces a discrete change at shuttle position C in discharge area as a function of shuttle position. Accordingly, shuttle positions between shuttle positions C and D define a high-range stage corresponding to a shuttle position where the discharge area is changed by a portion of the shuttle having a second conical slope.

If shuttle 14 was instead a single stage shuttle, such as shuttle 54 shown in FIG. 8, then the solid line between the shuttle positions C and D in FIG. 9 would reflect discharge area as a function of shuttle position. Accordingly, no discrete change would occur at shuttle position C and shuttle 54 would provide only a low-range stage and a mid-range stage. Understandably, a variety of conical surfaces may be selected for outer surface 26 of shuttle 14. Outer surface 26 of shuttle 14 in FIGS. 5–7 corresponds to right circular cones. Other cone types may produce a curved, instead of linear, discharge area change as a function of shuttle position. However, changes in discharge area as a function of shuttle position along such a curved line still constitute continuous changes in discharge area and, thus, do not define discrete discharge area stages. Some sort of discontinuous change, such as occurs at shuttle positions A and C in FIG. 9 for a two stage shuttle, may however define discrete discharge area stages.

Within the mid-range and high-range stages discussed above, discharge velocity of a water jet from discharge nozzle 48 may gradually increase as shuttle 14 extends rearward. Advantageously, in the low-range stage, the level of acceleration normally provided by the discharge pump may be obtained since shuttle 14 does not change discharge area. Even so, top speed may be improved by reducing discharge area in the mid-range and high-range stages. A further aspect of the invention includes boring the discharge nozzle to increase the level of acceleration normally provided by the discharge pump in the low-range stage. A shuttle may be provided in a tail cone assembly that nevertheless improves top speed. Accordingly, both top speed and acceleration at lower speeds may be improved by the aspects of the invention.

A two stage shuttle provides the additional advantage of increasing discharge area at a first rate with respect to shuttle position within the mid-range stage and changing discharge area at a second rate with respect to shuttle position within the high-range stage. The second rate may be greater than the first rate of discharge area change. The three discrete discharge area stages may be particularly advantageous for use with increasingly popular four-stroke engines and high-powered two-stroke engines, such as available in newer personal watercraft. The presently more common lower power two-stroke engines might achieve similar, though somewhat less advantageous performance improvements using a single stage shuttle without risking jet pump damage in the high-range stage due to the increased back pressure from further restricting discharge area.

As is apparent from FIG. 2, a bias mechanism such as spring 34 partially governs the shifting characteristics of shuttle 14. Location and size of inlet orifice 28, clearance 22, etc. may also contribute to shifting characteristics. Such factors in combination determine the amount of force, as applied by pump back pressure sufficient to extend shuttle 14 from recess 16. For a particular selected design having an inlet orifice size and position and shuttle clearance, different springs, or other bias mechanisms may be simply interchanged to produce different shifting characteristics.

A shuttle stop 36 shown in FIG. 2 constitutes a sleeve inserted between the shaft of a bolt 42 and spring 34 that limits the range of motion of shuttle 14. An optional spacer 38 may be placed so as to impart a two-fold effect. Spacer 38 may both effectively extend shuttle stop 36 further limiting range of extension of shuttle 14 as well as compress spring 34, increasing the bias of shuttle 14 into recess 16. Additional spacers, for example, a washer 40 may be added to further tune these two shifting characteristics. Accordingly, a kit containing components for a user to install and tune tail cone assembly 10 may provide multiple springs 34, spacers 38, and/or washers 40 as well as shuttle 14 and/or shuttle 54 to provide a large range of operator choice in performance enhancements. Multiple shuttles 14 and/or shuttles 54 may be included with front portions of different lengths to match desired performance criteria.

According to a further aspect of the invention, a tail cone assembly for a watercraft jet pump includes a tail cone body having a front end adapted for mounting and a rear end with a shuttle recess formed therein, a self-actuated shuttle biased into the shuttle recess, a pump back pressure inlet orifice through the tail cone body and into the shuttle recess, and a grit screening device associated with the inlet orifice. The shuttle recess has a side wall and a grit exhaust groove in the side wall. The shuttle has a front portion with an outer surface that is complementary to the side wall except for the grit exhaust groove in the side wall. The shuttle has a rear portion with an outer conical surface of two different conical slopes that are positioned to determine two discrete stages of jet pump discharge area upon extension of the shuttle from the shuffle recess. The assembly exhibits a shuttle clearance between the recess side wall and the complementary outer surface of the shuttle. Both the grit groove and the inlet orifice are positioned at gravitational low points within the assembly. Also, the grit screening device restricts grit having a size greater than or equal to the shuttle clearance from entering the inlet orifice.

Observation has identified certain materials and dimensions for the components shown in the Figures that have proven effective. However, the Figures are not drawn to scale and are not limited to any particular dimensions shown therein. Similarly, while the materials and dimensions described below have proven effective, those of ordinary skill will appreciate that additional materials and dimensions within the scope of the aspects of the invention described herein may also prove effective. Body 12 of tail cone assembly 10 may be machined from a metal billet, such as 6061 aluminum billet. Shuttle 14 may be constructed from polymeric materials, for example, ultra high molecular weight polymers, such as TIVAR™ 1000 available from Poly High Solidur, Inc. in Fort Wayne, Ind. Bolt 42 may be a 2.75 inch long, ¼×20 stainless steel shoulder bolt. Alternatively, bolt 42 may be a No. 10×24 stainless steel shoulder bolt. The front portion of shuttle 14 may have an outer diameter of 1.25 inches at outer surface 24 and a varying length to accommodate different pump designs. The rear portion of shuttle 14 may have a length of 1.75 inches spanning the portion of shuttle 14 having outer surface 26. To accommodate the two different slopes of a two-stage shuttle, such shuttle may have a slightly larger outer diameter at outer surface 24 of 1.5 inches, such as shown diagrammatically in FIG. 8. Shuttle stop 36 may be designed to provide a shuttle travel of about 1.125 inches along bolt 42.

Springs with a range of characteristics have been shown suitable, however, a spring with a load of 25 pounds-force (lb-f)±5 lb-f at 2.125 inches and a spring rate of 38 lb-f per inch so as to provide a load rate of 63 lb-f at a deflection of 1.67 inches has performed exceptionally well. Alternative springs include one with a load of 20 lb-f±5 lb-f at 2.125 inches and a spring rate of 30 lb-f per inch to provide a load rate of 50 lb-f at a deflection of 1.67 inches. Another suitable spring has a load of 15 lb-f±2 lb-f at 2.25 inches and a spring rate of 35 lb-f per inch. A further spring has a load of 20 lb-f±2 lb-f at 2.25 inches and a spring rate of 47 lb-f per inch. Understandably, the four specific springs described may define a range of suitable springs. Other springs outside of such range may also be suitable depending upon the particular watercraft jet pump.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A tail cone assembly for a watercraft jet pump comprising:

a tail cone body having a front end adapted for mounting and a rear end with a shuttle recess formed therein, the shuttle recess including a side wall;

a self-actuated shuttle biased into the shuttle recess, the shuttle having a rear portion with an outer conical surface positioned to determine jet pump discharge area upon extension of the shuttle from the shuttle recess and the the shuttle having a front portion including an outer surface complementary to the side wall, the assembly exhibiting a clearance of from about 0.020 to about 0.040 inches between the side wall and the outer surface; and a pump back pressure inlet orifice through the tail cone body and into the shuttle recess.

2. The assembly of claim 1 wherein:

the shuttle recess comprises a right circular cylindrical opening having a side wall and a bottom, the inlet orifice entering the shuttle recess through the bottom;

the shuttle is biased into the shuttle recess with a spring;

a front portion of the shuttle comprises an outer cylindrical surface complementary to the shuttle recess cylindrical opening; and the shuttle outer conical surface corresponds to a right circular cone.

3. The assembly of claim 1 wherein the shuttle recess comprises a side wall with a grit exhaust groove therein.

4. The assembly of claim 3 wherein the grit groove and inlet orifice are both positioned at gravitational low points within the assembly.

5. The assembly of claim 3 wherein:

the shuttle recess comprises a right circular cylindrical opening having a side wall and a bottom, the inlet orifice entering the shuttle recess through the bottom;

the shuttle is biased into the shuttle recess with a spring;

a front portion of the shuttle comprises an outer cylindrical surface complementary to the shuttle recess cylindrical opening; and the shuttle outer conical surface corresponds to a right circular cone.

6. The assembly of claim 1 wherein the shuttle recess comprises a side wall and a front portion of the shuttle comprises an outer surface complementary to the side wall, the assembly exhibiting a shuttle clearance between the side wall and the outer surface and the assembly further comprising a grit screening device associated with the inlet orifice that restricts grit having a size greater than or equal to the shuttle clearance from entering the inlet orifice.

7. The assembly of claim 1 comprised by a watercraft jet pump.

8. The assembly of claim 1 comprised by a personal watercraft.

9. A tail cone assembly for a watercraft jet pump comprising:

a tail cone body having a front end adapted for mounting and a rear end with a shuttle recess formed therein;

a self-actuated shuttle biased into the shuttle recess, the shuttle having a rear portion with an outer conical surface of at least two different conical slopes that are positioned to determine at least two stages of jet pump discharge area upon extension of the shuttle from the shuttle recess; and a pump back pressure inlet orifice through the tail cone body and into the shuttle recess.

10. The assembly of claim 9 wherein:

the shuttle recess comprises a right circular cylindrical opening having a side wall and a bottom, the inlet orifice entering the shuttle recess through the bottom;

the shuttle is biased into the shuttle recess with a spring;

a front portion of the shuttle comprises an outer cylindrical surface complementary to the shuttle recess cylindrical opening; and the shuttle outer conical surface corresponds to right circular cones.

11. The assembly of claim 9 wherein the at least two slopes consist of two slopes.

12. The assembly of claim 9 wherein the at least two stages comprise discrete stages.

13. The assembly of claim 9 wherein the shuttle recess comprises a side wall with a grit exhaust groove therein.

14. The assembly of claim 13 wherein the grit groove and inlet orifice are both positioned at gravitational low points within the assembly.

15. The assembly of claim 9 wherein the shuttle recess comprises a side wall and a front portion of the shuttle comprises an outer surface complementary to the side wall, the assembly exhibiting a clearance of from about 0.020 to about 0.040 inches between the side wall and the outer surface.

16. The assembly of claim 9 wherein the shuttle recess comprises a side wall and a front portion of the shuttle comprises an outer surface complementary to the side wall, the assembly exhibiting a shuttle clearance between the side wall and the outer surface and the assembly further comprising a grit screening device associated with the inlet orifice that restricts grit having a size greater than or equal to the shuttle clearance from entering the inlet orifice.

17. The assembly of claim 9 comprised by a watercraft jet pump exhibiting three discrete discharge area stages consisting of a low-range stage corresponding to a shuttle position where the discharge area is unchanged by the shuttle, a mid-range stage corresponding to a shuttle position where the discharge area is changed by a portion of the shuttle having a first conical slope, and a high-range stage corresponding to a shuttle position where the discharge area is changed by a portion of the shuttle having a second conical slope.

18. The assembly of claim 9 comprised by a personal watercraft exhibiting three discrete jet pump discharge area stages.

19. A tail cone assembly for a watercraft jet pump comprising:

a tail cone body having a front end adapted for mounting and a rear end with a shuttle recess formed therein, the shuttle recess having a side wall and a grit exhaust groove in the side wall;

a self-actuated shuttle biased into the shuttle recess, the shuttle having a front portion with an outer surface that is complementary to the side wall, except for the grit exhaust groove in the side wall, and having a rear portion with an outer conical surface of two different conical slopes that are positioned to determine two discrete stages of jet pump discharge area upon extension of the shuttle from the shuttle recess, the assembly exhibiting a shuttle clearance between the side wall and the complementary outer surface;

a pump back pressure inlet orifice through the tail cone body and into the shuttle recess, both the grit groove and the inlet orifice being positioned at gravitational low points within the assembly; and a grit screening device associated with the inlet orifice that restricts grit having a size greater than or equal to the shuttle clearance from entering the inlet orifice.

20. The assembly of claim 19 wherein:

the shuttle recess comprises a right circular cylindrical opening having a side wall and a bottom, the inlet orifice entering the shuttle recess through the bottom;

the shuttle is biased into the shuttle recess with a spring;

a front portion of the shuttle comprises an outer cylindrical surface complementary to the shuttle recess cylindrical opening; and the shuttle outer conical surface corresponds to right circular cones.

21. The assembly of claim 19 comprised by a watercraft jet pump exhibiting three discrete discharge area stages consisting of a low-range stage corresponding to a shuttle position where the discharge area is unchanged by the shuttle, a mid-range stage corresponding to a shuttle position where the discharge area is changed by a portion of the shuttle having a first conical slope, and a high-range stage corresponding to a shuttle position where the discharge area is changed by a portion of the shuttle having a second conical slope.

22. The assembly of claim 19 comprised by a personal watercraft exhibiting three discrete jet pump discharge area stages.

23. A tail cone assembly for a watercraft jet pump comprising:

a tail cone body having a front end adapted for mounting and a rear end with a shuttle recess formed therein, the shuttle recess including a side wall with a grit exhaust groove therein;

a self-actuated shuttle biased into the shuttle recess, the shuttle having a rear portion with an outer conical surface positioned to determine jet pump discharge area upon extension of the shuttle from the shuttle recess; and a pump back pressure inlet orifice through the tail cone body and into the shuttle recess.

24. A tail cone assembly for a watercraft jet pump comprising:

a tail cone body having a front end adapted for mounting and a rear end with a shuttle recess formed therein, the shuttle recess including a side wall;

a self-actuated shuttle biased into the shuttle recess, the shuttle having a rear portion with an outer conical surface positioned to determine jet pump discharge area upon extension of the shuttle from the shuttle recess and the shuttle having a front portion including an outer surface complementary to the side wall, the assembly exhibiting a shuttle clearance between the side wall and the outer surface;

a pump back pressure inlet orifice through the tail cone body and into the shuttle recess; and a grit screening device associated with the inlet orifice that restricts grit having a size greater than or equal to the shuttle clearance from entering the inlet orifice.

* * * * *